United States Patent [19]

Sato

[11] 4,213,604

[45] Jul. 22, 1980

[54] AUTOMATIC ORIGINAL HANDLING DEVICE

[75] Inventor: Tadashi Sato, Kokubunji, Japan

[73] Assignee: Canon Kabushiki Kaisha, Tokyo, Japan

[21] Appl. No.: 922,294

[22] Filed: Jul. 6, 1978

[30] Foreign Application Priority Data

Jul. 19, 1977 [JP] Japan ..... 52-86203
Jul. 19, 1977 [JP] Japan ..... 52-86204

[51] Int. Cl.[2] ..... B65H 9/10

[52] U.S. Cl. ..... 271/233; 271/246; 271/269; 271/276

[58] Field of Search ..... 271/233, 242, 271–273, 271/276, 269, 243, 244, 246

[56] References Cited

U.S. PATENT DOCUMENTS

| | | | |
|---|---|---|---|
| 3,309,078 | 3/1967 | Nash | 271/276 X |
| 3,829,083 | 8/1974 | Shiina | 271/4 |
| 3,844,552 | 10/1974 | Bleau | 271/245 |
| 4,003,570 | 1/1970 | Yamanaka | 271/269 X |
| 4,043,665 | 8/1977 | Caldwell | 271/276 X |

*Primary Examiner*—Richard A. Schacher
*Attorney, Agent, or Firm*—Fitzpatrick, Cella, Harper & Scinto

[57] ABSTRACT

This specification discloses an automatic original handling device for use with a copying apparatus and for automatically placing an original to be copied at a predetermined position on the original carriage surface of the copying apparatus. The original conveyor means of the device is provided with registration means for pushing the trailing end of the original to register the trailing end to a predetermined position on the conveyor means or provided with the registration means and restraining means for stopping the original moved by the registration means to register the leading end of the original at a predetermined position, thus registering the trailing end or the leading end of the original at the predetermined position, whereafter the original is conveyed over a predetermined distance and placed at a proper position on the original carriage surface.

13 Claims, 5 Drawing Figures

2
5
53
51
F
52
50
54
E
8
3
12
49
38
39
9
7

15
13
14
17
13
G
H
58
56
55
57

AUTOMATIC ORIGINAL HANDLING DEVICE

BACKGROUND OF THE INVENTION

1. Field of the Invention

This invention relates to an automatic original handling device used in a copying apparatus, and more particularly to a device for automatically conveying and stopping an original to be copied to and at the original carriage portion of a copying apparatus and for automatically returning the original from the apparatus after the optical scanning necessary for the image formation corresponding to the original has been effected, and for automatically conveying another original in succession.

2. Description of the Prior Art

Heretofore, placement of an original on the original carriage portion of a copying apparatus has often been manually effected by the operator of the copying apparatus and this has required much labor and much time and moveover, has suffered from not a little deviation of the original from its proper position, thus preventing proper copying from being performed.

As a solution to these problems, there is known a conveyor device for automatically conveying an original to the original carriage portion.

For example, U.S. Pat. No. 3,844,552 discloses a construction in which original conveyor means comprising a belt passed over two rollers is provided on the original carriage portion so that originals are conveyed by the friction between the belt and the surface of the original carriage and originals are registered and stopped by an original stop member provided at an end of the original carriage surface.

However, in such device, since flexible originals conveyed by the friction between the belt and the original carriage surface is mechanically stopped by the stop member, the originals nipped between the belt and the original carriage surface tend to be bent or wrinkled or otherwise damaged.

As another example, U.S. Pat. No. 3,829,083 discloses a device in which originals placed on an original support bed are fed therefrom by a separating roller and the trailing end of original is detected by a microswitch in the course of its conveyance and after a predetermined time, conveyor rollers are stopped from rotating so that the original is placed at a predetermined position on the original carriage.

In case of such device, the drawbacks noted with respect to the above-described conveyor device are rarely encountered, but if the originals are not placed at an accurate position on the original support bed, namely, if the originals are obliquely placed on the bed or if the originals are obliquely fed by a separation roller, it is not possible to place the originals at an accurate position on the original carriage surface, and thus, proper copying cannot take place to a great inconvenience.

SUMMARY OF THE INVENTION

It is an object of the present invention to provide a device for automatically and accurately effecting successive conveyance of originals to be copied to the original carriage portion of a copying apparatus and collection of the used originals.

It is another object of the present invention to provide a device for automatically placing originals to be copied accurately at a designated position on the original carriage portion of a copying apparatus.

It is still another object of the present invention to provide a device for automatically registering originals to be copied at a predetermined position before they are placed on the original carriage portion of a copying apparatus.

It is yet still another object of the present invention to provide a device for automatically registering a next original accurately at a predetermined position when an original to be copied rests on the original carriage portion.

It is a further object of the present invention to provide an automatic original handling device for reliably bringing originals to be copied into intimate contact with the original carriage surface.

Other objects and effects of the present invention will become fully apparent from the following description of the invention taken in conjunction with the accompanying drawings. The above principal objects of the present invention may be achieved by the automatic original handling device which will be described below.

According to the present invention, the automatic original handling device for automatically conveying sheet originals to the original carriage surface of a copying apparatus comprises belt conveyor means comprising a belt member passed over at least two rollers, and registration means for registering originals on the belt conveyor means to accurately convey the originals to a predetermined position on the original carriage surface before the originals are conveyed to the original carriage surface by the belt conveyor means.

DESCRIPTION OF THE PREFERRED EMBODIMENTS

Figure 1:
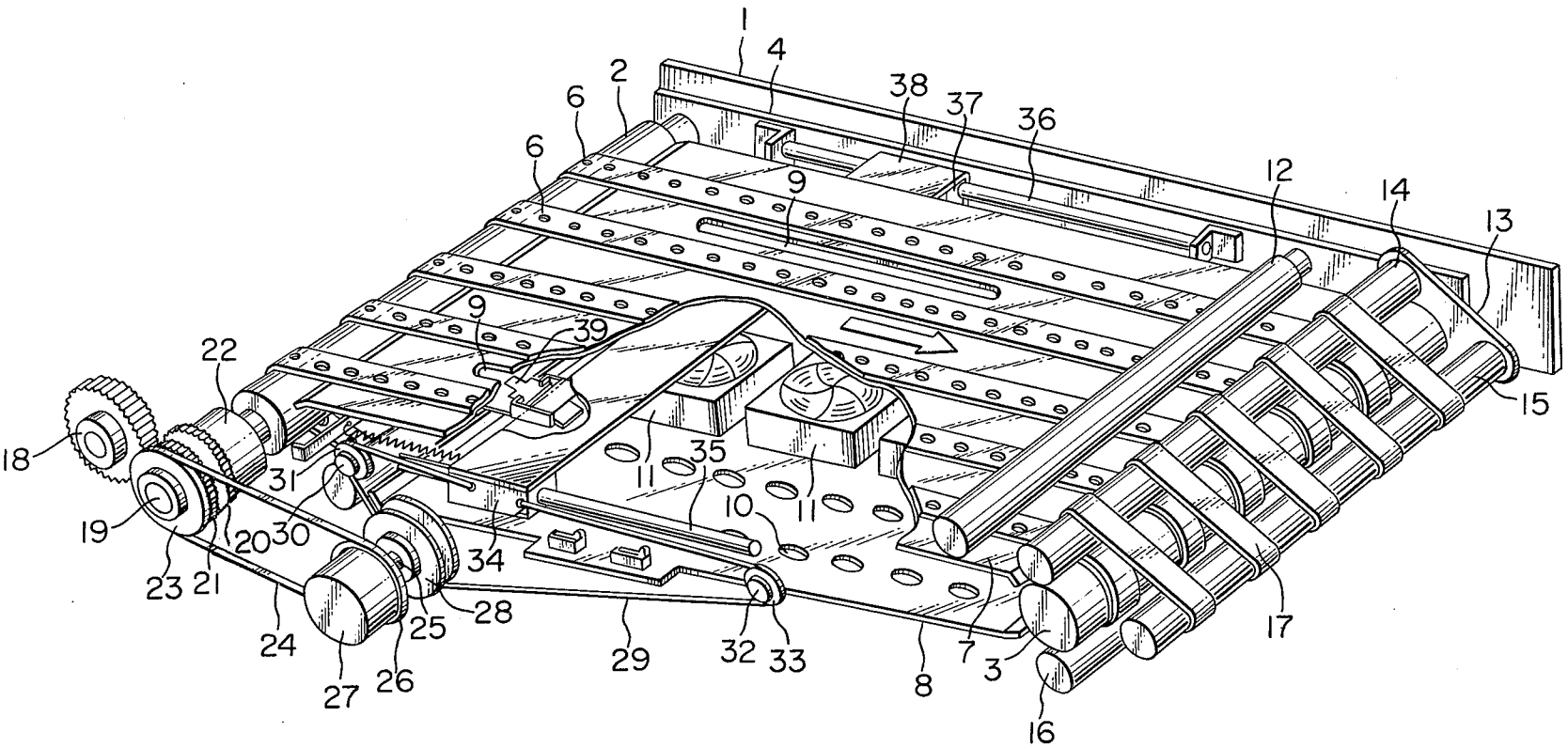
FIG. 1 is a perspective view of the automatic original handling device according to the present invention.

Referring to FIG. 1, it is a perspective view showing an embodiment of the original conveyor device according to the present invention. Designated by 1 is a side plate for supporting the conveyor device and two such plates are provided on the opposite sides. Inwardly of the side plates, there are two roller side plates 4 chiefly supporting rollers 2 and 3. In the present embodiment, five belts 5 are passed over the rollers 2 and 3. An original fed from the left of the drawing by unshown feed means rides on the conveyor belts 5 and is moved with the belts in the direction of arrow A toward an original carriage surface which underlies the conveyor device. Each of the conveyor belts 5 is formed with suitably spaced apart small apertures 6. Inwardly of the conveyor belts 5, there are upper and lower plates 7 and 8 which are secured to the roller side plates 4. The upper plate 7 is formed with a groove 9. The lower plate 8 is formed with a number of apertures 10 which are slightly larger than the apertures 6 in the conveyor belts 5. These apertures 10 and 6 are provided to cause an original to be adsorbed to the conveyor belts by a suction fan 11 disposed centrally of the lower plate 8 so as to prevent the original from dropping off the conveyor belts 5. The upper plate 7 covers the inner side of the belts so as to prevent the original from being blown up by the blast from the suction fan. On the conveyor belts 5 adjacent to their one end, a stop roller 12 is rotatably mounted with respect to the roller side plate 4. The stop roller 12 is used to arrest the original at this position, and is rotated or stopped in synchronism with the rotation or stoppage of the conveyor belts 5.

Adjacent to the roller 3 where the conveyor belts 5 turn its direction of movement, there is a unit for ensuring the change of direction of the original. This unit has two direction changing side plates 13 provided inwardly of the roller side plate 4, and rollers 14, 15 and 16 rotatably mounted between these side plates. Of these rollers, the roller 14 has its end rotatably journalled also to the side plates 1 of the conveyor device. Belts 17 are passed over the rollers 14, 15 an 16. The belts 17 overlap the conveyor belts 5 on the roller 3. An original conveyed to the position of the roller 3 is nipped between the belts 5 and 17 to change its direction of movement and is thus conveyed toward the original carriage portion.

The conveyor device is driven by a drive motor, not shown. The rotational force of the drive motor is first transmitted to a drive gear 18. The drive gear 18 is mesh-engaged by a conveyor gear 20 and a registration gear 21 both supported on a shaft 19. The conveyor gear 20 transmits the rotation force by the operation of an electromagnetic clutch 22 coaxial therewith. As a result, the conveyor device is operated so that the original fed from the left is conveyed on the conveyor belt 5.

On the other hand, the rotational force transmitted to the registration gear 21 is further transmitted to the original registration mechanism of the present invention. Such rotational force is further transmitted to a pulley 26 mounted on a registration shaft 25 via a pulley 23 coupled to the gear 21 and a belt 24 passed thereover. The rotational force is still further transmitted to a wire pulley 28 by the operation of an electromagnetic clutch 27. A length of wire 29 is passed over the wire pulley 28. One end of the wire 29 is secured to a slide bed 34 through a pulley 31 rotatably mounted on a shaft 30, and the other end of the wire 29 is secured also to the slide bed 34 through a rotatable pulley 33 on a shaft 32. The slide bed 34 is slidably mounted on a slide shaft 35, secured to the roller side plate 4, by means of a bearing. Another slide shaft 36 is secured to the other roller side plate 4, and a slide bed 37 is slidably mounted on the slide shaft 36, The slide beds 34 and 37 have a movable plate 38 secured thereto. The movable plate 38 is reciprocally movable along the direction of movement of the conveyor belts 5. Two original registration means having a registration plate 39 are mounted to the movable plate 38. The registration plate 39 has its end projectable from the groove 9 to push the original when the movable plate 38 is moved, thereby registering the original to a predetermined position.

The outlines of the original conveyor device according to the present invention have been described above.

Description will now be made of the original registration mechanism by reference to FIGS. 2 and 3. In the ensuing description, the method of registerting the trailing end of the original to a predetermined position will chiefly be discussed.

Figure 2:
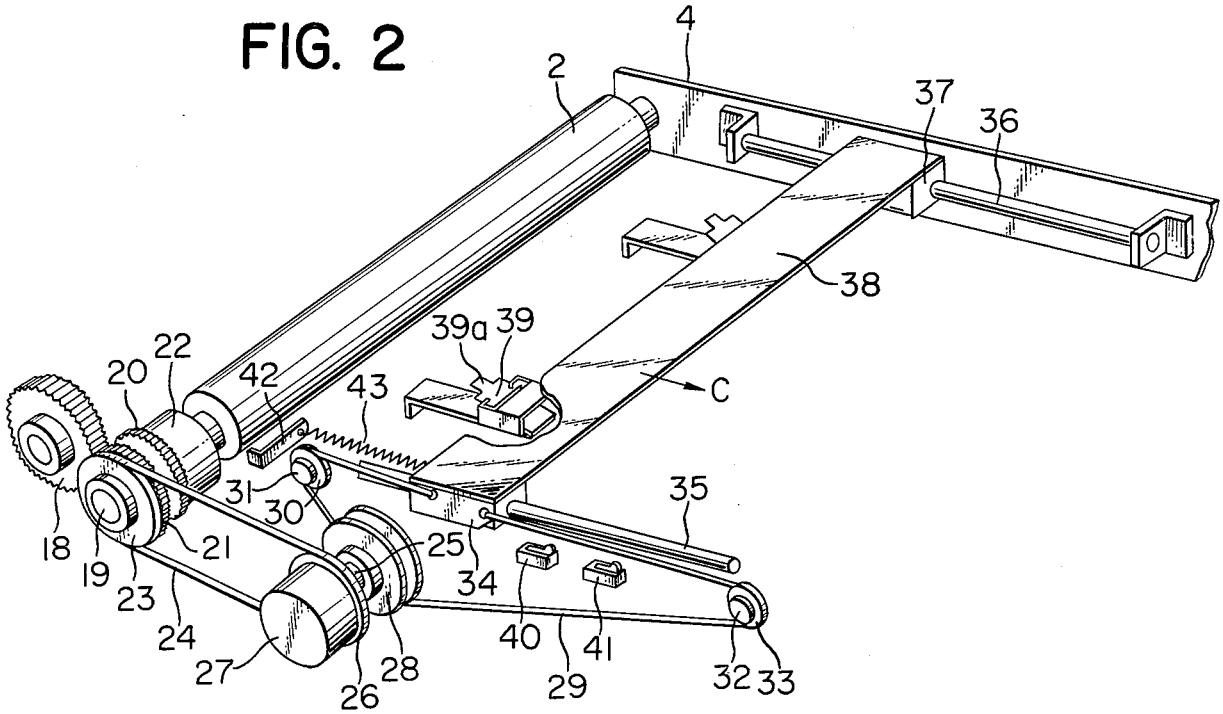
FIG. 2 is a perspective view of a portion of the automatic original handling device for showing the details of the registration mechanism for originals.

FIG. 2 is a perspective view showing the registration mechanism of the present invention. When an orignal is fed to the original carriage portion and stopped there to be optically scanned, the next original comes onto the conveyor belts and is stopped thereon. At this time, the aforementioned electromagnetic clutch 27 is operated to move the movable plate 38 in the direction of arrow C. Thereupon, the registration plate 39 mounted to the lower portion of the movable plate 38 cocks up and the end **39*a* of the registration plate pushes the trailing end of the original on the belts. When the slide bed 34 supporting the movable plate 38 actuates a microswitch 40 or 41 provided on the lower plate 8 of the conveyor device, the electromagnetic clutch 27 is deenergized. Upon deenergization of the electromagnetic clutch 27, the movable plate 38 is returned to its initial position by the force of a spring 43 mounted between a fixed plate 42 secured to the upper plate 7 of the conveyor device and the slide bed 34. Instead of providing the spring 43, it is also possible to rotate the pulley 28 in the opposite direction, thereby returning the movable plate 38** to its initial position.

The position whereat the microswitch 40 or 41 is installed may be predetermined in accordance with the size or length of the original. Thus, the original has its trailing end registered on the belts in accordance with the position of the microswitch. In the shown embodiment, two microswitches are provided and one of these is selectively used. A greater number of microswitches may be installed and the point whereat the registration plate is reverted to backward movement may be changed in accordance with the size of the original. It is also possible to vary the operating time of the electromagnetic clutch 27 in one way or other to thereby change the position of movement of the movable plate 38, namely, the registerted position of the original.

Figure 3:
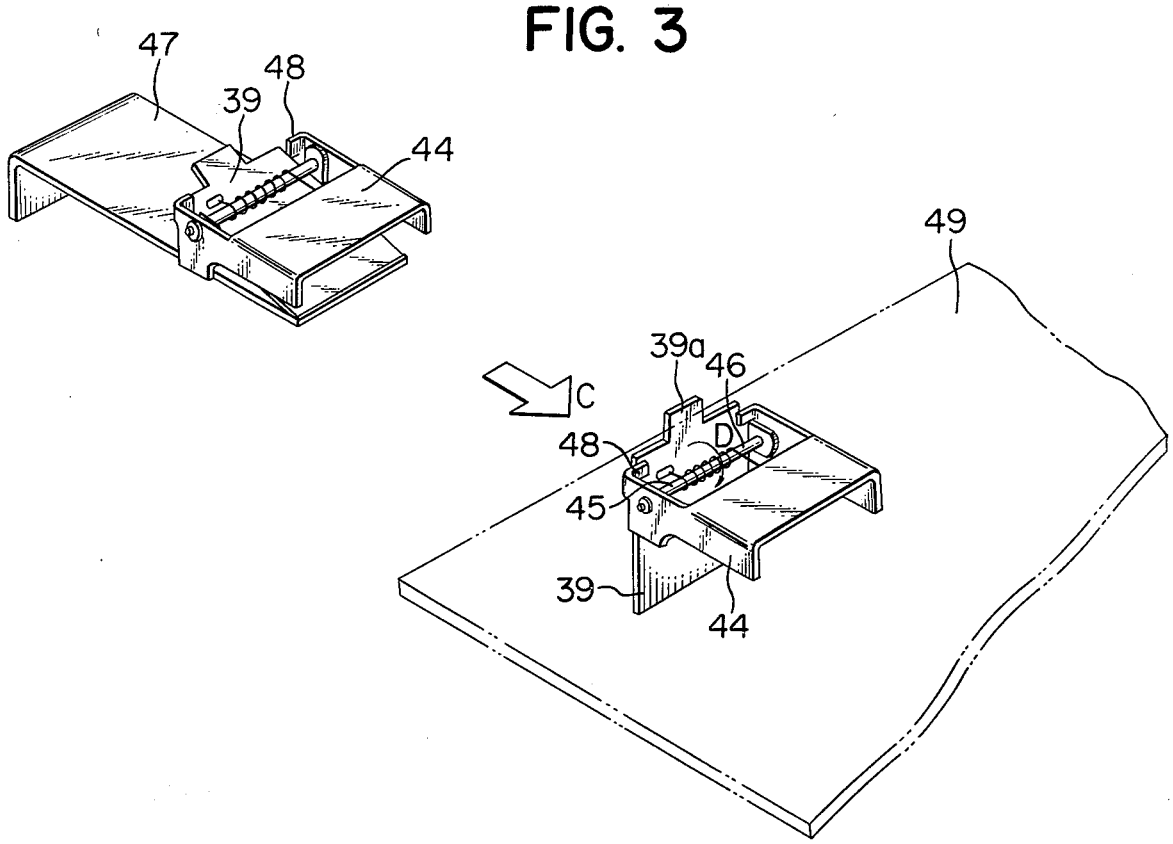
FIG. 3 is an enlarged view of a portion of the registration means.

FIG. 3 shows detailed construction and operation of the registration means mounted to the movable plate. The registration plate 39 is supported by a shaft 45 passing through a support plate 44. The registration plate 39 is biased in the direction of arrow by a spring 46.

When an original is being conveyed, the registration plate 39 normally assumes its prone position by its lower end being pushed by a release plate 47 secured to the conveyor device. When the conveyor belts are stopped and the registration plate pushes the trailing end of an original to register it to a predetermined position, the registration means is moved in the direction of arrow C. At this time, the prone registration plate 39 is gradually released from the release plate 47 to cock up and strike against a stop 48 provided on a support plate 44, so that the registration plate is stopped. The end **39*a* of the registration plate 39 is projected through the groove 9 (FIG. 1) in the upper plate 7 of the conveyor device and in this position, the registration plate goes to push the original 49. This registration plate can push and register sheet originals as well as fairly thick and heavy originals by suitably adjusting the strength of the spring 46. The registration of the original by the registration plate 39 is not restricted to the aid of the spring bias of the spring 46 but the lower end of the registration plate 39** may be formed as a "weight" or may have attached thereto a "weight" to accomplish the registration of the original. As a further alternative, the registration plate or similar projection may be designed to be vertically projected from the movable plate when the original is to be registered.

Having registered the original to its predetermined position, the registration means is returned to its initial position by the action of the spring 43, as already noted. The registration plate 39 has its lower end portion again pushed by the release plate 47 to assume its prone position. Thus, the registration plate 39 does not interfere with the movement of a next oncoming original even if it is fed onto the conveyor belts by feed means.

Figure 4:
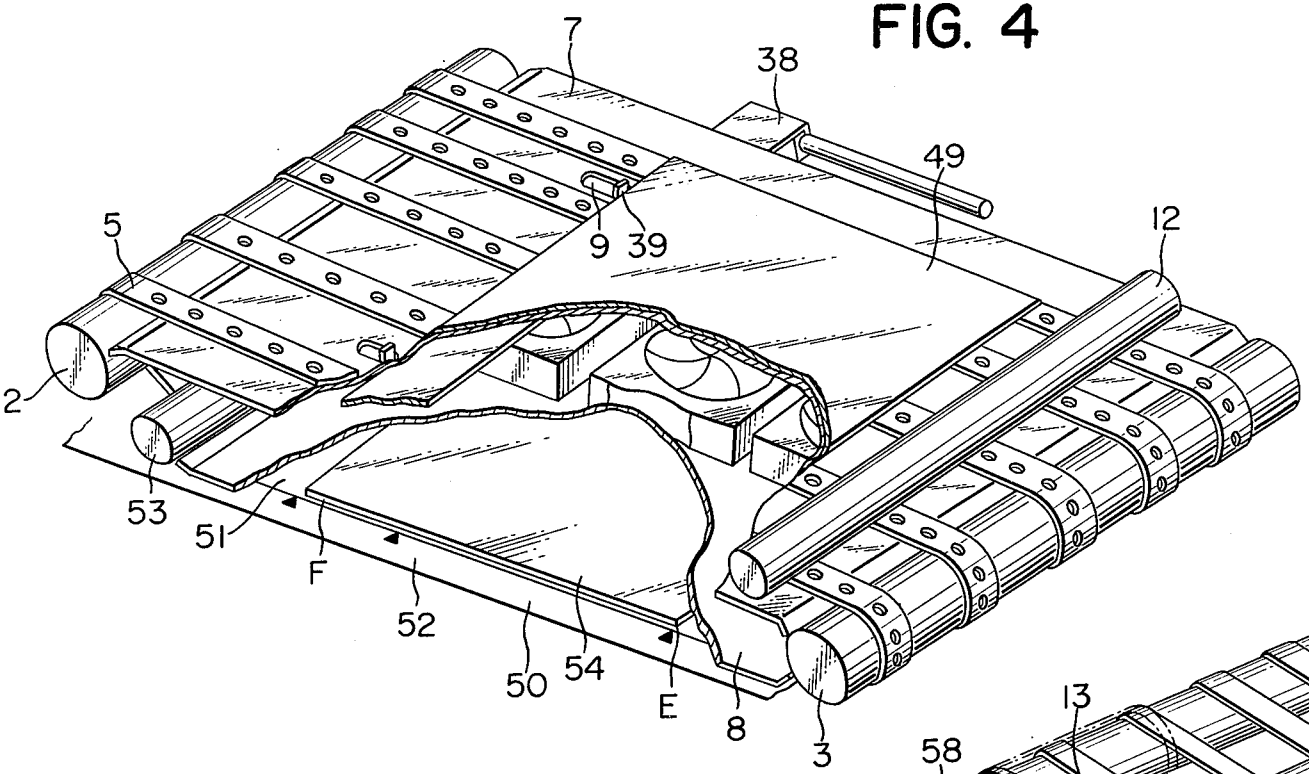
FIG. 4 illustrates the manner in which positioning of an original is carried out according to the present invention.

Reference is now had to FIG. 4 to describe how the original registered to its predetermined position is transported to the original carriage portion of the copying apparatus. Usually, the original carriage portion 50 has a transparent glass plate 51 for the exposure to original image and a support plate 52 provided with index marks for designating the sizes of the originals. The support plate 52 supports the transparent glass plate 51. The glass 51 is provided with an unshown optical system for scanning an original.

The roller 53 of the conveyor device is brought into contact with the original carriage portion 50 with the conveyor belts 5 interposed therebetween, but a gap is provided between the belts adjacent to the other roller 3 and the original carriage portion. More specifically, if the present conveyor device is sectioned along the direction of movement of the conveyor belts, it will be seen that there is formed a wedge-shaped space between the original carriage portion and the conveyor belts. The original is conveyed through such space and stopped at a predetermined position on the transparent glass 51. At this time, the roller 3 is lowered to enable the conveyor belts to hold down the original against the transparent glass. The upward and downward movement of this roller 3 will further be described.

When the original 54 on the original carriage portion 50 is being optically scanned at this position, the next original 49 on the now stationary conveyor belts 5 has its trailing end pushed by the registration plate 39 so that it is registered to its predetermined position. When the optical scanning has been completed, the electromagnetic clutch (FIG. 1) is operated in synchronism therewith to rotate the roller 2 and thus the conveyor belts 5 again. By this, the original 54 on the original carriage portion 50 is transported from this conveyor device onto a discharge tray or the like. In the meantime, the next original 49 is transported to the original carriage portion 50 and when the trailing end thereof has come to the trailing end reference position E, the conveyor belts 5 are controlled so as to be stopped. Such control may be accomplished by rotating the drive motor by an amount corresponding to the distance of movement of the original 49 from its trailing end registered position to its trailing end reference position E, or by operating the electromagnetic clutch 22 (FIG. 1) which transmits rotation force to the roller 2 for a time during which the belts are moved over said distance. The trailing end registered position can be readily seen from the position of the preset microswitch.

Depending on the apparatus, the leading end of an original is registered to the leading end reference F of the original carriage portion 50. In such case, the trailing end of the original 49 is pushed by the registration plate 39 and the leading end thereof is caused to bear against the stop roller 12, thereby registering the original at its leading end. The original thus registered can be conveyed accurately from its leading end registered position to the leading end reference F of the original carriage portion by the same method as that already described.

In either of the above-described trailing end or leading end registration, the conveyance of the next original is controlled so that the original 49 is stopped short of the stop roller 12 with the trailing end thereof stopped at a point slightly past the groove 9, as shown.

In the case of the trailing end registration, the position of the microswitch for changing over the movement of the registration plate 39 is selected so that the registration plate 39 does not push the original so as to strike against the stop roller 12. Likewise, in the case of the leading end registration, the microswitch installed in accordance with the size of the original must be selected so as not to push the original too much. In the case of the leading end registration, a thin original could be pushed by the registration plate so that the central portion thereof is more or less bulged, but there is no fear that such original is damaged, because it is not held down from above it. Where the original is a thick one, the strength of the spring 46 attached to the registration plate 39 may be adjusted so that the registration plate may assume its prone position after the leading end of the original has come to bear against the stop roller 12.

According to the present invention, as has hitherto been described, the original is pre-registered to its predetermined position by the registration plate and any positional deviation may be thus corrected, so that the original can be placed at the proper position on the original carriage portion without any deviation by the subsequent conveyance.

In the shown embodiment, two registration means are provided on the movable plate, whereas any desired number of such registration means may be provided in accordance with the various sizes of originals.

Figure 5:
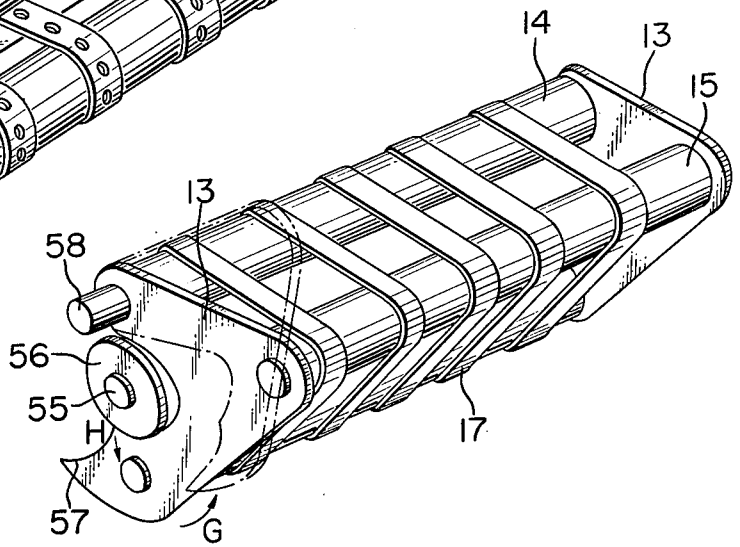
FIG. 5 is a perspective view of the direction changing unit of the automatic original handling device according to the present invention.

Description will now be made of the direction change unit for changing the direction of the original. FIG. 5 shows an example of the mechanism in which a gap is provided between the conveyor belts 5 and the original carriage portion in the position as shown in FIG. 1 to ensure smooth conveyance of the originals. Cam followers 56 are provided on the shaft 55 of the roller 3 at the opposite ends thereof, and camming surfaces 57 in contact with the cam followers 56 are provided in a portion of the direction changing side plates 13. When the conveyor belts are stopped and an original has come to rest at a predetermined position on the original carriage portion, the direction changing side plates 13 are rotated in the direction of arrow G about the shaft 58 of the roller 14 by means of unshown cam or the like, whereby the cam followers 56 are lowered in the direction of arrow H along the camming surfaces 57. Thus, the roller 3 is lowered into intimate contact with the original on the original carriage portion. When this roller 3 has been lowered, the image formation process such as the optical scanning or the like is carried out in the image formation apparatus such as copying machine or the like. Immediately after completion of the image formation, the direction changing side plates 13 are rotated in the opposite direction to the arrow G by the action of a cam, not shown. By this, the camming surfaces 57 of the direction changing side plates are also moved to move the cam followers 56 upwardly. Thus, the roller 3 moved upwardly.

In this manner, the original can be positively brought into intimate contact with the original carriage portion when placed thereon. Moreover, during the conveyance of the original, the roller 3 is moved upwardly to form a gap between the conveyor belt and the original carriage portion so as to permit the original to be conveyed through such gap while being sucked.

As has hitherto been described in detail, the present invention pre-registers an original on the conveyor belts when the original is conveyed toward the original carriage portion and therefore, the original can be readily placed at a proper position on the original carriage portion simply by conveying the registered original over a predetermined distance. It is also possible to eliminate the drawback that the original is obliquely conveyed toward the original carriage portion to prevent proper copying from being performed. In addition to these advantages, the present invention enables the original to be registered to the trailing end reference or the leading end reference in accordance with the type of the copying apparatus. Moreover, when optical scanning is taking place with an original resting on the original carriage portion, the next original can be registered to save the time and enhance the copying efficiency.

I claim:

1. An automatic original handling device for automatically conveying sheet originals to the original carriage surface of a copying apparatus, comprising:

belt conveyor means including intermittently movable belt means trained around at least two rollers;

registration means, movable along said belt means when said belt means is not moving, for registering an original on said belt conveyor means so that the original is conveyed accurately to a predetermined position on the original carriage surface; and means for adusting the position of said registration means.

2. An automatic original handling device according to claim 1, wherein the belt conveyor means is provided on the original carriage surface and said registration means is so disposed as to be projected from within said belt conveyor means so that the original is registered on said belt conveyor means.

3. An automatic original hndling device according to claim 1, wherein said registration means, when registering the original, is projected above the level of said belt conveyor means to push the original and at all other times, said registration means assumes its prone position so as not to interfere with conveyance of the original.

4. An automatic original handling device according to claim 3, wherein the trailing end of the original is registered to a predetermined position by said registration means, whereafter the original is conveyed over a predetermined distance and placed accurately at the trailing end reference position on the original carriage portion.

5. An automatic original handling device according to claim 1, wherein said rollers are lowered to bring the original into intimate contact with the original carriage portion when said belt conveyor means is stopped, and said rollers are moved upwardly to ensure conveyance of the original by said belts when said belt conveyor means is being operated.

6. An automatic original handling device according to claim 1, wherein said belt conveyor means has a suction fan for preventing the drop of the original and a number of suction apertures formed in said belts.

7. An automatic original handling device for automatically conveying sheet originals to the original carriage surface of a copying apparatus, comprising:

belt conveyor means comprising a plurality of belts passed over at least two rollers;

restraining means for restraining the original on said belt conveyor means so as to set the leading end position of the original; and registration means for pushing the trailing end of the original on said belt conveyor means to cause the original to be restrained by said restraining means and register the leading end of the original in order that the original is accurately conveyed to a predetermined position on the original carriage surface, wherein the original is registered before it is conveyed to the original carriage surface by said belt conveyor means.

8. An automatic original handling device according to claim 7, wherein said registration means, when registering the original, is projected above the level of said belt conveyor means to push the original and during the other time, said registration means assumes its prone position so as not to interfere with conveyance of the original.

9. An automatic original handling device according to claim 7, wherein the leading end of the original is registered to a predetermined position by said restraining member, whereafter the original is conveyed over a predetermined distance and placed accurately at the leading end reference position on the original carriage portion.

10. An automatic original handling device according to claim 7, wherein said rollers are lowered to bring the original into intimate contact with the original carriage portion when said belt conveyor means is stopped, and said rollers are moved upwardly to ensure conveyance of the original by said belts when said belt conveyor means is being operated.

11. An automatic original handling device according to claim 7, wherein said belt conveyor means has a suction fan for preventing the drop of the original and a number of suction apertures formed in said belts.

12. An automatic original handling device according to claim 1 or 7, wherein said registration means is operative when said belt conveyor means is stopped.

13. An automatic original handling device according to claim 1 or 7, wherein the next original is registered by said registration means while the first original is resting on the original carriage surface.

* * * * *